US006883956B1

(12) United States Patent
Hildreth

(10) Patent No.: US 6,883,956 B1
(45) Date of Patent: Apr. 26, 2005

(54) WINDSHIELD PRIMER MIXING DEVICE

(76) Inventor: John C. Hildreth, 111 Campbell St., Port Jefferson, NY (US) 11777

( * ) Notice: Subject to any disclaimer, the term of this patent is extended or adjusted under 35 U.S.C. 154(b) by 0 days.

(21) Appl. No.: 10/443,172

(22) Filed: May 23, 2003

(51) Int. Cl.[7] ..... B01F 11/00

(52) U.S. Cl. ..... 366/110; 366/112; 366/211; 366/240; 366/605

(58) Field of Search ..... 366/112, 111, 110, 366/212, 240, 210, 211, 605

(56) References Cited

U.S. PATENT DOCUMENTS

| | | | | | |
|---|---|---|---|---|---|
| 838,806 | A | * | 12/1906 | Pemberton | 366/210 |
| 1,413,651 | A | * | 4/1922 | Burnett | 366/240 |
| 1,489,024 | A | * | 4/1924 | Burnett | 366/209 |
| 1,768,429 | A | * | 6/1930 | Stoney | 366/110 |
| 2,356,004 | A | * | 8/1944 | Price | 366/110 |
| 2,458,313 | A | * | 1/1949 | Stevens | 366/108 |
| 2,759,712 | A | * | 8/1956 | Hvistendahl | 366/209 |
| 3,045,987 | A | * | 7/1962 | Cake | 366/100 |
| 3,061,280 | A | * | 10/1962 | Kraft et al. | 366/110 |
| 3,128,082 | A | * | 4/1964 | Cline | 366/210 |
| 3,198,502 | A | * | 8/1965 | Thompson | 366/108 |
| 3,517,913 | A | * | 6/1970 | Rossem | 366/112 |
| 3,542,344 | A | * | 11/1970 | Oberhauser | 366/202 |
| 4,085,955 | A | * | 4/1978 | Salle | 366/212 |
| 4,316,672 | A | * | 2/1982 | Kerscher | 366/212 |
| 4,619,532 | A | | 10/1986 | Schmidt, III | 366/110 |
| 4,691,725 | A | * | 9/1987 | Parisi | 366/111 |
| 4,818,115 | A | * | 4/1989 | Tornqvist | 366/212 |
| 4,842,415 | A | | 6/1989 | Cane et al. | 366/110 |
| 5,273,357 | A | * | 12/1993 | Currie | 366/110 |
| 5,322,358 | A | | 6/1994 | Coho et al. | 366/235 |
| 5,641,228 | A | * | 6/1997 | Prokopenko | 366/114 |
| 5,662,416 | A | | 9/1997 | Dwigans, II | 366/209 |
| 5,971,599 | A | | 10/1999 | Bothers | 366/142 |

* cited by examiner

*Primary Examiner*—Tony G. Soohoo

(57) ABSTRACT

A windshield primer mixing device includes a housing having a bottom wall, a top wall and a peripheral wall extending between the top and bottom walls. A guide is mounted on the housing. A mounting is slidably positioned on the guide. A motor is adapted for selectively urging the mounting upwardly on the guide. A power supply is operationally coupled to the motor. A pair of coupling assemblies selectively couples a pair of containers to the mounting. The containers are removably coupled to the mounting and the mounting moved up and down until the contents of the containers are effectively mixed.

10 Claims, 2 Drawing Sheets

WINDSHIELD PRIMER MIXING DEVICE

BACKGROUND OF THE INVENTION

1. Field of the Invention

The present invention relates to mixing devices and more particularly pertains to a new mixing device for thoroughly mixing windshield primer.

2. Description of the Prior Art

The use of mixing devices is known in the prior art. While these devices fulfill their respective, particular objectives and requirements, the need remains for a device that thoroughly mixes the primers use for installing a windshield. The primers are positioned along an edge of the windshield and along an edge of the window frame of the vehicle to ensure that a tight seal is formed. If the primer is not properly mixed, it is not as effective and can lead to minor problems such as leaks and more serious problems such as the ejection of the windshield during an accident. Typically, the primers are mixed by hand. This is accomplished by the shaking of the containers having the primer therein. This process is often time consuming and can lead to primers that are not effectively mixed.

SUMMARY OF THE INVENTION

The present invention meets the needs presented above by providing a device that automatically mixes the primer in a vigorous method to ensure effective dispersion of the components of the primer. Also, the mixing can be done while a windshield installer performs other duties.

Another object of the present invention is to provide a new mixing device that includes receiving members which can be easily adapted for holding a variety of sizes of containers.

To this end, the present invention generally comprises a housing having a bottom wall, a top wall and a peripheral wall extending between the top and bottom walls. A guide is mounted on the housing. A mounting is slidably positioned on the guide. A motor is adapted for selectively urging the mounting upwardly on the guide. A power supply is operationally coupled to the motor. A pair of coupling assemblies selectively couples a pair of containers to the mounting. The containers are removably coupled to the mounting and the mounting moved up and down until the contents of the containers are effectively mixed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
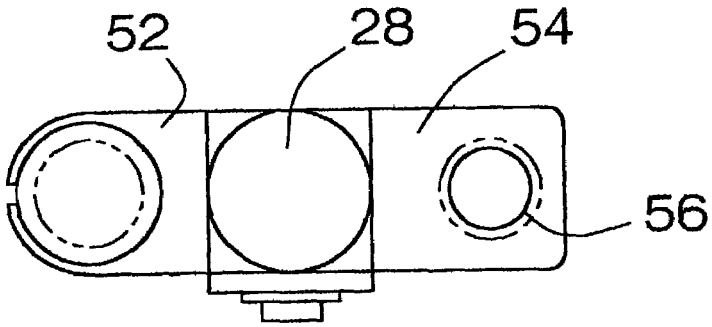
FIG. 2 is a schematic top view of the present invention.
Figure 1:
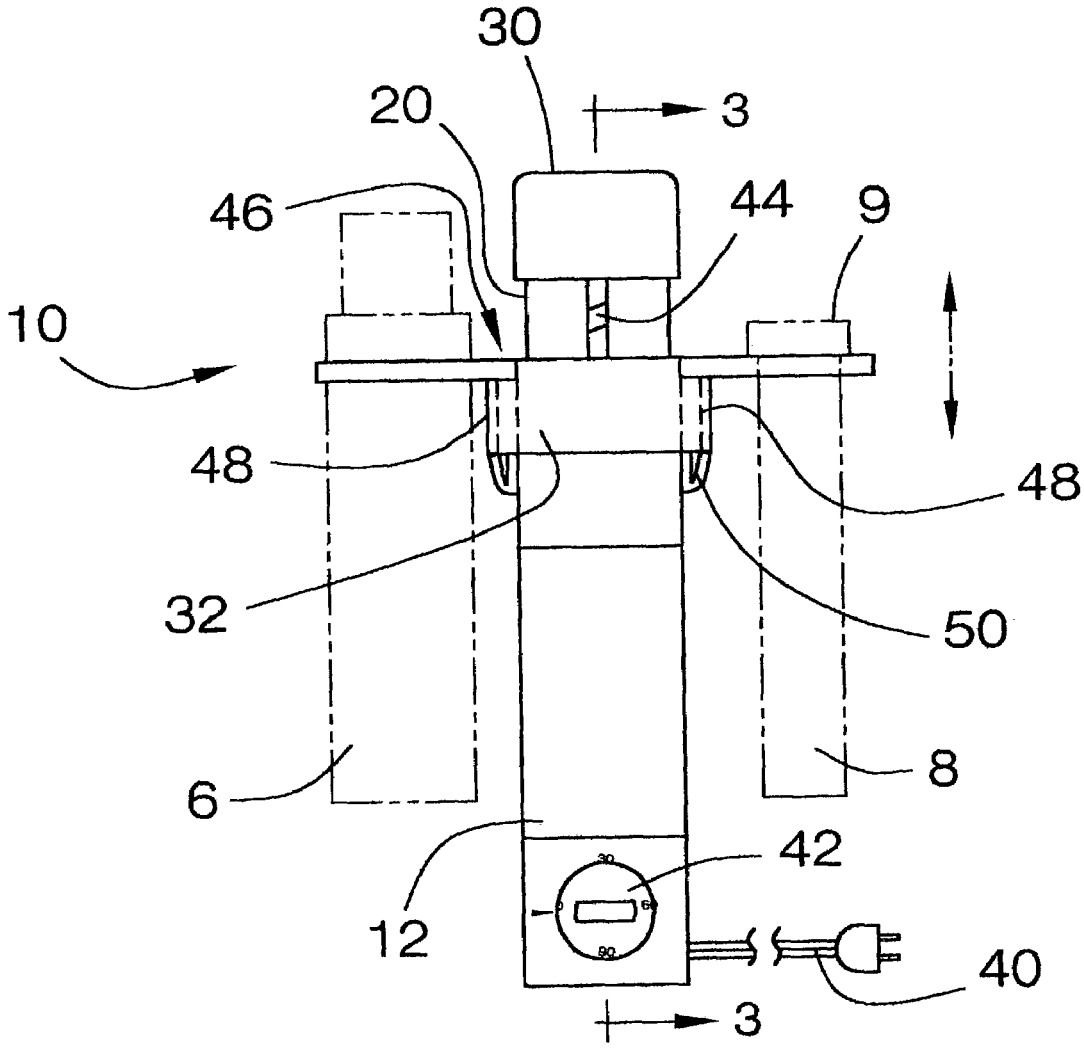
FIG. 1 is a schematic side view of a windshield primer mixing device according to the present invention.
Figure 4:
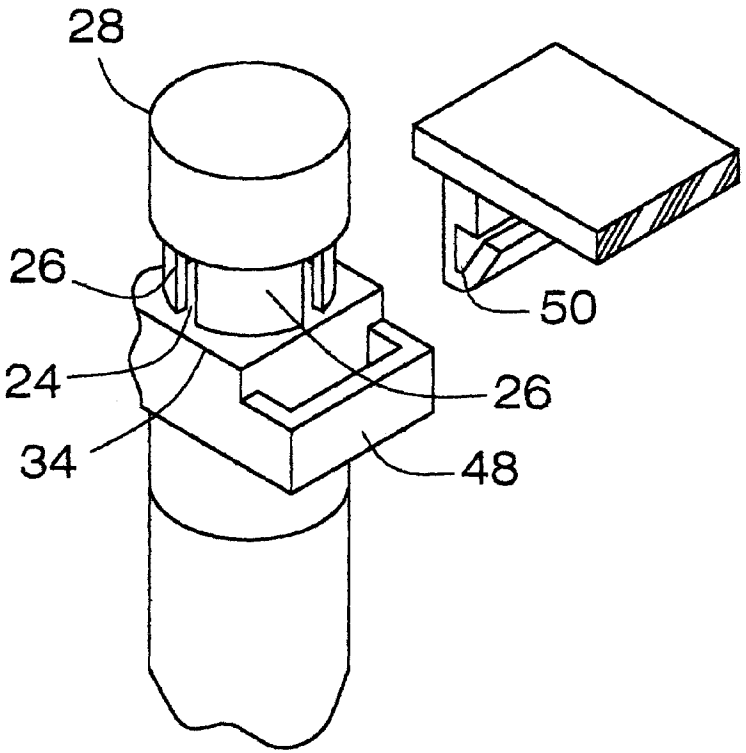
FIG. 4 is a schematic perspective view of the present invention.
Figure 3:
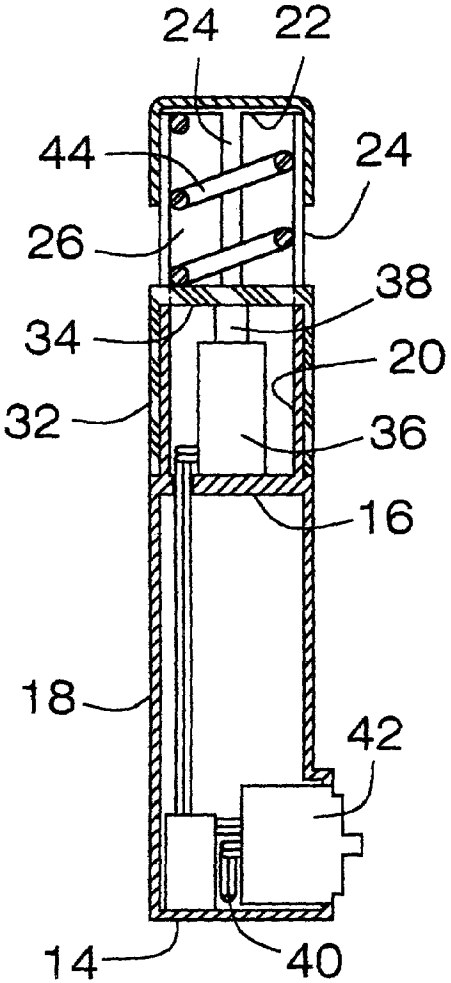
FIG. 3 is a schematic cross-sectional view taken along line 3—3 of FIG. 1 of the present invention.

With reference now to the drawings, and in particular to FIGS. 1 through 4 thereof, a new mixing device embodying the principles and concepts of the present invention and generally designated by the reference numeral 10 will be described.

As best illustrated in FIGS. 1 through 4, the windshield primer mixing device 10 generally comprises a housing 12 having a bottom wall 14, a top wall 16 and a peripheral wall 18 extending between the top 16 and bottom 16 walls.

A guide 20 is mounted on the housing 12. The guide 20 is positioned on and extends upwardly from the top wall 16. The guide 20 is substantially hollow and has an upper edge 22 defining an opening. The guide 20 has a generally cylindrical shape. The guide 20 has a plurality slots 24 therein extending downward through the upper edge 22. The slots 20 are spaced from each other and define vertical members 26 positioned between adjacent slots 24. A stop 28 is attached to the upper edge 22, though the upper edge 22 could have a wall thereon and the stop 28 could be formed by a peripheral ridge 30 extending around the outside of the guide 20.

A mounting 32 is slidably positioned on the guide 20. The mounting 32 is selectively movable between the top wall 16 and the stop 28. The mounting 32 comprises a sleeve positioned around the guide 20. The sleeve, or mounting 32, has an upper wall 34. The vertical members 26 extend through the upper wall 34 such that the upper wall 34 is spaced from and extends over the top wall 16. The sleeve 32 is slidably mounted on the vertical members 26.

A motor 36 is adapted for selectively urging the mounting 32 upwardly away from the housing 12. The motor 36 is mounted on the top wall 16. A lifting arm 38 is mechanically coupled to the motor 36. The lifting arm 38 is abutted against the upper wall 34 of the mounting 32. The motor 36 extends and retracts the lifting arm 38 when the motor 36 is turned on. The motor 36 is preferably a solenoid type device. A power supply 40 is operationally coupled to the motor 36. The power supply 40 is preferably an electrical cord which can be plugged into a standard outlet. However, batteries may also be used. An actuator 42 for selectively turning the motor 36 on or off is operationally coupled to the motor 36. Ideally, the actuator 42 comprises an analog timer switch so that the motor 36 may be turned on for a selected amount of time.

A biasing member 44 is adapted for biasing the mounting 32 downwardly toward the housing 12. The biasing member 44 preferably comprises a spring positioned within the guide 20 and extending between the stop 28 and the upper wall 34.

A pair of coupling assemblies 46 selectively couples a pair of containers 6, 8 of primer to the mounting 32. Each of the coupling assemblies 46 includes a first mating member 48 and a second mating member 50. The first mating members 48 may be selectively coupled with one of the second mating members 50. The first mating members 48 are attached to the mounting 32 and are positioned generally opposite of each other. Each of a pair of receiving members 52, 54 is attached to one of the second mating members 50 for selectively receiving one of the containers 6, 8. A first of the receiving members 52 comprises a clip. A second of the receiving members 50 comprises a panel having an aperture 56 extending therethrough. The first mating members 48 are preferably U-shaped brackets adapted for receiving the second mating members 50 which include a latch which is extendable into a space between the U-shaped brackets and the mounting 32. The clip of the first receiving member 52 may be made in a plurality of sized adapted for frictionally engaging a canister 6 of primer fluid. The aperture 56, as well, may be made in a variety of sizes and is adapted for receiving primer sticks 8 having a cap 9 that is wider than the body of the stick 8. The cap 9 is wider than the aperture 56 for holding the stick 6 within the second receiving member 50.

In use, the containers 6, 8 are removably coupled to the mounting 32 and the mounting 32 moved up and down until the contents of the containers 6, 8 are effectively mixed. The biasing member 44 aids the process by vigorously forcing the mounting 32 downward. The size and type of the motor 36 may be selected for its frequency, though it is preferred that the lifting arm 38 is extended to lift the mounting 32 a minimum of five times per second.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mixing device for selectively agitating containers such that contents positioned within the containers are fully intermixed, said device comprising:

a housing having a bottom wall, a top wall and a peripheral wall extending between said top and bottom walls;

a guide being mounted on said housing, said guide is positioned on and extending upwardly from said top wall, said guide being substantially hollow and having an upper edge defining an opening, said guide having a generally cylindrical shape, said guide having a plurality slots therein extending downward through said upper edge, said slots being spaced from each other, wherein said slots define vertical members positioned between adjacent slots, a stop being attached to said upper edge;

a mounting being slidably positioned on said guide, said mounting being selectively movable between said top wall and said stop, said mounting comprising a sleeve positioned around said guide, said sleeve having an upper wall, said vertical members extending through said upper wall such that said upper wall is spaced from and extends over said top wall;

a motor being adapted for selectively urging said mounting upwardly on said guide;

a power supply being operationally coupled to said motor;

a pair of coupling assemblies for selectively coupling a pair of the containers to said mounting; and wherein the containers are removably coupled to said mounting and said mounting moved up and down until the contents of the containers are effectively mixed.

2. The mixing device of claim 1, wherein each of said coupling assemblies including a first mating member and a second mating member, wherein each of said first mating members may be selectively coupled with one of said second mating members, each of said first mating members being attached to said mounting each of a pair of receiving members being attached to one of said second mating members for selectively receiving one of the containers.

3. The mixing device of claim 2, wherein a first of said receiving members comprises a clip, a second of said receiving members comprising a panel having an aperture extending therethrough.

4. The mixing device of claim 1, wherein said motor is mounted on said top wall, a lifting arm being mechanically coupled to said motor, said lifting arm being abutted against said upper wall of said mounting, wherein said motor extends and retracts said lifting arm when said motor is turned on.

5. The mixing device of claim 4, further including a biasing member being adapted for biasing said mounting downwardly toward said housing.

6. The mixing device of claim 5, wherein said biasing member comprising a spring positioned within said guide and extending between said stop and said upper wall.

7. The mixing device of claim 1, further including an actuator for selectively turning said motor on or off being operationally coupled to said motor.

8. The mixing device of claim 7, wherein said actuator comprises a timer such that said motor may be turned on for a selected amount of time.

9. The mixing device of claim 1, further including a biasing member being adapted for biasing said mounting downwardly on said guide.

10. A mixing device for selectively agitating containers such that contents positioned within the containers are fully intermixed, said device comprising:

a housing having a bottom wall, a top wall and a peripheral wall extending between said top and bottom walls;

a guide being mounted on said housing, said guide being positioned on and extending upwardly from said top wall, said guide being substantially hollow and having an upper edge defining an opening, said guide having a generally cylindrical shape, said guide having a plurality slots therein extending downward through said upper edge, said slots being spaced from each other, wherein said slots define vertical members positioned between adjacent slots, a stop being attached to said upper edge;

a mounting being slidably positioned on said guide, said mounting being selectively movable between said top wall and said stop, said mounting comprising a sleeve positioned around said guide, said sleeve having an upper wall, said vertical members extending through said upper wall such that said upper wall is spaced from and extends over said top wall;

a motor being adapted for selectively urging said mounting upwardly away from said housing, said motor being mounted on said top wall, a lifting arm being mechanically coupled to said motor, said lifting arm being abutted against said upper wall of said mounting, wherein said motor extends and retracts said lifting arm when said motor is turned on;

a power supply being operationally coupled to said motor;

an actuator for selectively turning said motor on or off being operationally coupled to said motor, said actuator comprising a timer, wherein said motor may be turned on for a selected amount of time;

a biasing member being adapted for biasing said mounting downwardly toward said housing, said biasing member comprising a spring positioned within said guide and extending between said stop and said upper wall;

a pair of coupling assemblies for selectively coupling a pair of the containers to said mounting, each of said coupling assemblies including a first mating member and a second mating member, wherein each of said first mating members may be selectively coupled with one of said second mating members, each of said first mating members being attached to said mounting and being positioned generally opposite of each other, each of a pair of receiving members being attached to one of said second mating members for selectively receiving one of the containers, a first of said receiving members comprising a clip, a second of said receiving members comprising a panel having an aperture extending therethrough; and wherein the containers are removably coupled to said mounting and said mounting moved up and down until the contents of the containers are effectively mixed.

* * * * *